US007127971B1

(12) United States Patent
Braun

(10) Patent No.: US 7,127,971 B1
(45) Date of Patent: Oct. 31, 2006

(54) HAND TOOL SAFETY DEVICE

(76) Inventor: James Braun, 181 W. Swiss Farm Way, Midway, UT (US) 84049

( * ) Notice: Subject to any disclaimer, the term of this patent is extended or adjusted under 35 U.S.C. 154(b) by 0 days.

(21) Appl. No.: 10/852,580

(22) Filed: May 24, 2004

Related U.S. Application Data

(63) Continuation-in-part of application No. 10/228,155, filed on Aug. 26, 2002, now abandoned.

(60) Provisional application No. 60/315,239, filed on Aug. 27, 2001.

(51) Int. Cl.
*B25B 23/16* (2006.01)

(52) U.S. Cl. ..... 81/177.1; 81/489

(58) Field of Classification Search ..... 248/211, 248/215, 301, 302, 304, 305, 306, 339, 690, 248/692; D8/66, 70; 81/177.1, 489, 487; 30/514, 517, 518, 520
See application file for complete search history.

(56) References Cited

U.S. PATENT DOCUMENTS

| | | | | |
|---|---|---|---|---|
| 3,583,106 A | | 6/1971 | Dobbertin | 51/170 |
| 3,728,793 A | | 4/1973 | Makinson et al. | 30/383 |
| D232,153 S | | 7/1974 | Pepper | D8/99 |
| 3,823,474 A | | 7/1974 | Ionescu | 30/383 |
| 3,945,119 A | | 3/1976 | Nagashima et al. | 30/383 |
| 4,406,064 A | | 9/1983 | Goss | 30/296 |
| 4,411,071 A | | 10/1983 | Takahashi et al. | 30/381 |
| 4,482,181 A | * | 11/1984 | Shepherd | 294/12 |
| 4,658,455 A | * | 4/1987 | Skillern | 7/105 |
| 4,693,006 A | | 9/1987 | Wehle | 30/383 |
| 4,787,145 A | * | 11/1988 | Klicker et al. | 30/275.4 |
| 4,805,308 A | | 2/1989 | Ritola | 30/382 |
| 4,895,336 A | * | 1/1990 | Lieberman | 248/690 |
| 4,912,848 A | | 4/1990 | Bidanset | 30/383 |
| 4,964,217 A | | 10/1990 | Siede et al. | 30/383 |
| 5,145,226 A | * | 9/1992 | LaFontaine | 294/27.1 |
| 5,791,708 A | | 8/1998 | Capriotti | 294/55 |
| D477,523 S | * | 7/2003 | Malvasio | D8/105 |

FOREIGN PATENT DOCUMENTS

| | | |
|---|---|---|
| WO | WO 99/55503 | 11/1999 |

* cited by examiner

*Primary Examiner*—Alfred Joseph Wujciak, III
(74) *Attorney, Agent, or Firm*—Thorpe North & Western LLP

(57) ABSTRACT

A combination handle and safety device configured to be attached to a hand tool to enable the hand tool to be safely stored upon a timber includes a handle, configured to be grasped by a user of the hand tool. Each of a pair of hanger prongs extends outwardly from an end of the handle and define an open channel disposable over a top of the timber. One of the hanger prongs extends along a side of the timber. A handle support extends from an opposite end of the handle and has a notch formed therein. The notch includes at least two engagement points oriented to engage the top of the timber to securely engage the timber with the device to enable the hand tool to be safely stored upon the timber.

17 Claims, 6 Drawing Sheets

HAND TOOL SAFETY DEVICE

This application is a continuation-in-part of presently pending U.S. patent application Ser. No. 10/228,155, filed Aug. 26, 2002 now abandoned, which claims priority to U.S. Provisional Patent Application No. 60/315,239, filed Aug. 27, 2001, which are each hereby incorporated herein by reference.

BACKGROUND OF THE INVENTION

1. Field of the Invention

The present invention relates generally to a safety and storage device for use on hand held tools. More particularly, the present invention relates to a safety device that can be attached to a hand tool to enable a user to safely store the safety device, and thus the hand tool, upon a structure such as a timber.

2. Related Art

Hand tools are often used in homes and the construction industry to perform a variety of tasks. Because they are generally portable devices, hand tools have found application in a wide array of projects and can be used in a variety of locations on the job site. While hand tools provide the convenience of portability, temporarily storing a hand tool to free a user's hands to perform additional tasks has proved problematic. For instance, while building a structure, a worker or user may have to alternately measure, saw and nail lumber. When using a saw, a worker will typically put the saw down while measuring or nailing, then pick it up again to perform a cut.

Thus, while the saw or other hand tool can be simply placed upon the ground or some other structure to free a user's hands, this generally requires that the operator interrupt the present task to set the tool down, then retrieve the tool when it is needed again. While some hand tools have been provided with hooks or other devices that allow a user to temporarily "hook" the tool to his or her tool belt instead of setting the tool down, heavy hand tools or power tools cannot be so easily stored, as the user's belt cannot support the heavy load.

An area in which these problems have proved particularly troublesome is in the construction or installation of joists, rafters and trusses. Because this type of work often demands that a builder use a hand-held power saw in elevated locations, temporary storage of the saw becomes even more problematic. Placing or storing the saw upon a nearby structure is difficult and dangerous, as the saw may fall or be knocked off the structure and potentially fall many feet, possibly damaging the saw or injuring a worker below. Thus, having to temporarily set a saw aside not only affects the efficiency of the builder, but creates a dangerous working environment for all workers on the job site.

Some builders, frustrated with attempts to temporarily store a saw on a nearby structure, have taken to forming a cut in the structure and using the cut to temporarily support the saw. This practice not only adds to the time required to store the saw, but it also results in unnecessary and dangerous cuts being formed in important structural elements such as joists or rafters. Not only can important structural elements be weakened by this method, but the resulting storage solution is not reliable, as the saw blade can be easily damaged or the saw can become easily dislodged.

SUMMARY OF THE INVENTION

It has been recognized that it would be advantageous to develop a safety device for use on hand tools that allows the tools to be safely yet temporarily stored on a structure. The present invention provides a combination handle and safety device configured to be attached to a hand tool to enable the hand tool to be safely stored upon a timber, including a handle, configured to be grasped by a user of the hand tool. A pair of hanger prongs can extend outwardly from an end of the handle and can define an open channel disposable over a top of the timber. One of the hanger prongs can extending along a side of the timber. A handle support can extend from an opposite end of the handle and can have a notch formed therein. The notch can include at least two engagement points oriented to engage the top of the timber to securely engage the timber with the device to enable the hand tool to be safely stored upon the timber.

In accordance with another aspect of the invention, a combination handle and safety device configured to be attached to a hand tool to enable the hand tool to be safely stored upon a timber is provided, including: a handle, configured to be grasped by a user of the hand tool. A pair of hanger prongs can extend outwardly from an end of the handle and can define an open channel disposable over a top of the timber. One of the hanger prongs can extend along a side of the timber. A handle support can extend from an opposite end of the handle and can have a concave section formed therein. The concave section can include at least two engagement corners engageable with a top of the timber, the at least two engagement corners being configured to each contact the timber at the top of the timber to securely engage the timber with the safety device to enable the hand tool to be safely stored upon the timber.

In accordance with another aspect of the invention, a method for securing a hand tool to a timber is provided, including the steps of: attaching a handle to the hand tool, the handle being configured to be grasped by a user of the hand tool; disposing about the timber a pair of hanger prongs extending outwardly from an end of the handle; engaging a side of the timber with one of the pair of hanger prongs; and engaging a top of the timber with at least two engagement corners disposed within a concave section of a handle support attached to the handle to thereby enable the hand tool to be safely stored upon the timber.

Additional features and advantages of the invention will be apparent from the detailed description which follows, taken in conjunction with the accompanying drawings, which together illustrate, by way of example, features of the invention.

DETAILED DESCRIPTION OF THE INVENTION

Figure 1:
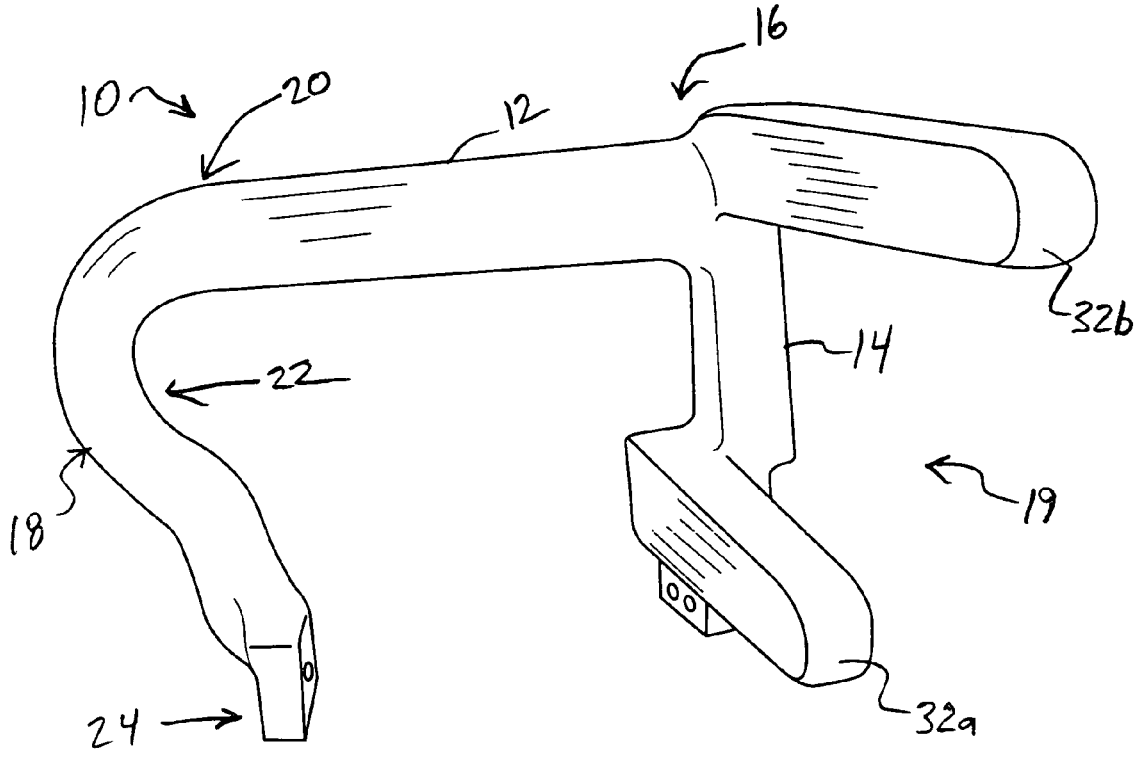
FIG. 1 is a perspective front view of a hand tool safety device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in the attached figures, a hand tool safety device, indicated generally at 10, in accordance with the present invention is shown for use with a hand or power tool (11 in FIGS. 3–6). The safety device can be used to provide additional gripping area for the tool and to also provide a means for hanging or storing the hand tool on a timber or other structure (54 in FIGS. 3–6). The device can be used on a variety of hand tools and power tools to allow a user of the tool to temporarily secure the tool to a timber. In accordance with one embodiment of the present invention, the safety device includes a handle 12 that can be configured to be grasped by a user of the hand tool. A support 14 can be coupled to an end 16 of the handle and can include a pair of hanger prongs 32*a*, 32*b* extending outwardly therefrom.

Figure 2:
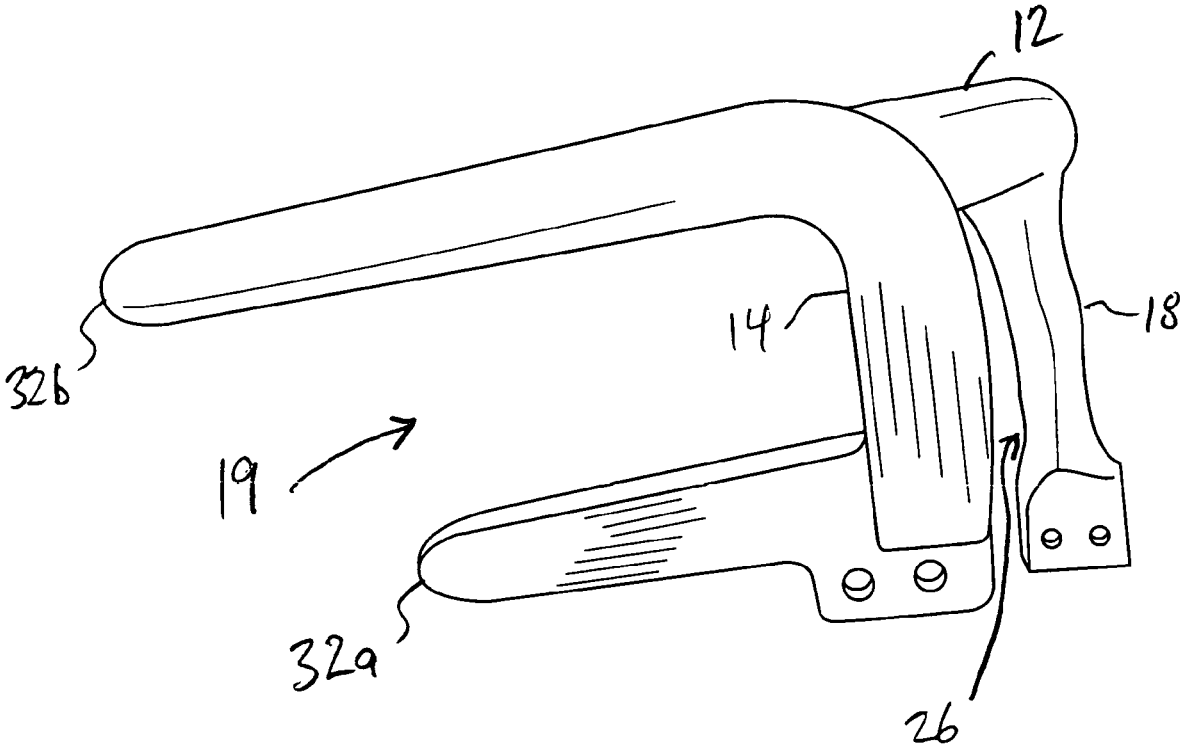
FIG. 2 is a side view of the safety device shown in FIG. 1.

The hanger prongs can define an open channel (19 in FIG. 2) which is disposable over a top 54*a* of the timber 54. Thus, the safety device can be installed over or "hung" along the lengthwise portion of a timber, such as the portion that spans across a roof. Thus, the safety device does not require an end of the timber to be exposed in order for the safety device to be stored on the timber. As shown for example in FIG. 3, one of the pair of hanger prongs, 32*a* in this example, can extend along a side 54*b* of the timber. The degree of engagement between the hanger prong and the timber can vary, and in one embodiment, the prong 32*a* contacts the timber from substantially a top of the prong to substantially a bottom of the prong. In this manner, a majority of a gripping surface of the prong is utilized to engage the timber.

A handle support 18 can be coupled to an opposite end 20 of the handle 12. As best shown in FIGS. 3–6, the handle support can include a notch 26 formed therein for engaging a top 54*a* of the timber 54. In one aspect of the invention, the notch can include at least two engagement points 27 oriented to engage the top of the timber to securely engage the timber with the device to enable the hand tool 11 to be safely stored upon the timber. In one aspect of the invention, the notch includes a concave section formed in the handle support with the engagement points including at least two engagement corners engageable with a top of the timber. While the engagement points can engage the timber in a variety of locations, in one aspect of the invention the two engagement points engage the timber at outward ends (57 in FIGS. 3 and 6) of the top of the timber. In this manner, the force applied to the timber by the engagement points or corners can be distributed evenly across the top of the timber.

The hanger prongs 32 and engagement points 27 can collectively allow the safety device to be used in a variety of applications. In one application, a construction worker can utilize the handle 12 to manipulate the hand tool during use of the tool. When the worker is no longer using the hand tool, the hanger prongs 32 can be disposed over a timber 54 and the engagement points will engage the top 54*a* of the timber. The weight of the hand tool will then cause the prongs and engagement points to securely bind the safety device to the timber, securely holding the hand tool in place on the timber.

Figure 3:
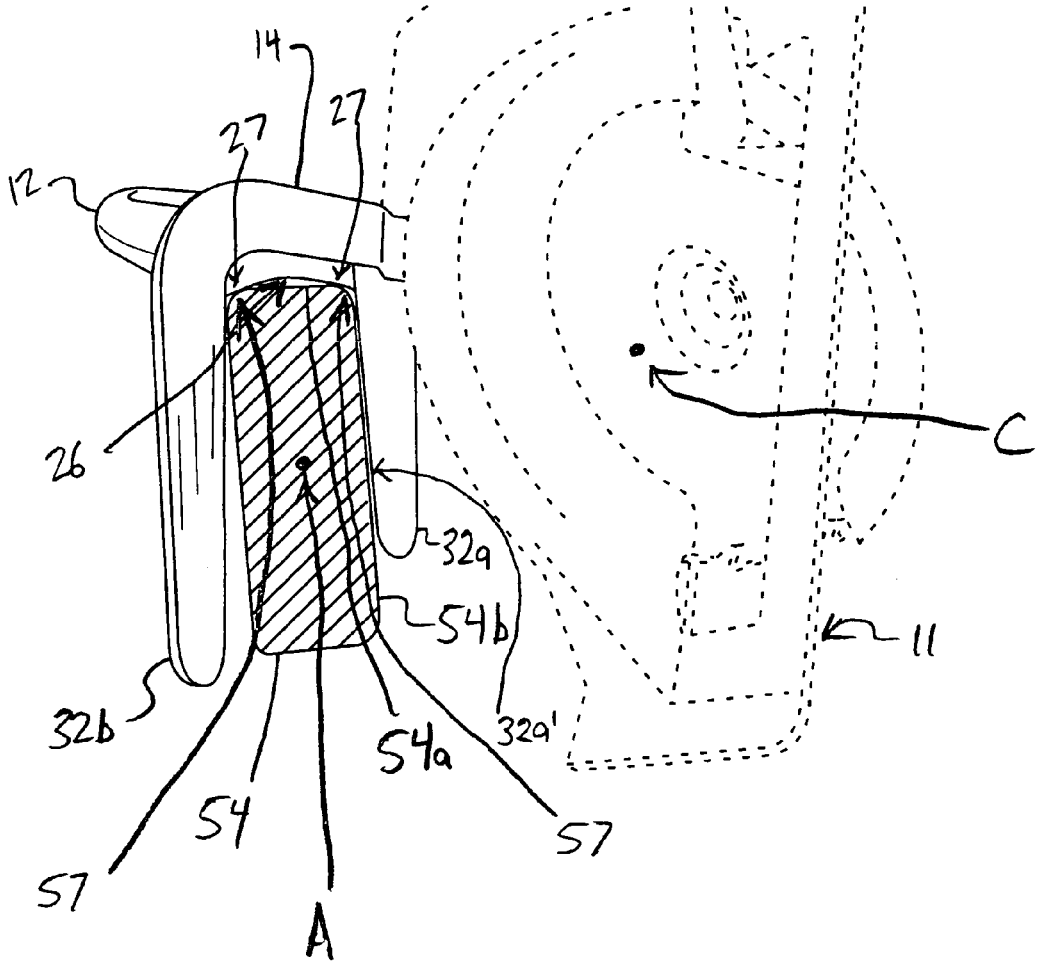
FIG. 3 is an end view of the safety device of FIG. 1 attached to a hand tool and engaged with a timber.

As shown in FIG. 3, in one aspect of the invention, the handle 12 can be coupled to a side of the hand tool 11. In this manner, a center of gravity (represented schematically by "C") of the combined handle and hand tool can be offset from an axis A of the timber. In this manner the timber is bound or "kinked" between the hangar prongs 32 and the engagement points 27 and an edge 32*a*' of the hanger prong 32*a* is forced into the timber when the hand tool is stored upon the timber. The safety device thus simultaneously applies force to the timber along the side 54*b* of the timber and the top 54*a* of the timber to maximize the "grip" the device has on the timber. This feature allows the safety device to be used on timbers that are greatly sloped, such as rafter beams, while still safely holding a hand tool securely in place.

As shown in FIG. 1, the handle support 18 can project arcuately away from the handle 12 in a first segment 22 and return arcuately toward the handle in a second section 24. The handle support can thus be configured to provide support for the handle while increasing available hand space within the handle. This feature of the device can be advantageous in that additional hand space can be provided to allow users with large hands to easily grasp the handle 12. This feature is also advantageous when using the device on hand tools used in cold temperatures. For example, a worker working in a cold environment can still manipulate the handle and the hand tool, even while wearing heavy winter gloves.

Figure 6:
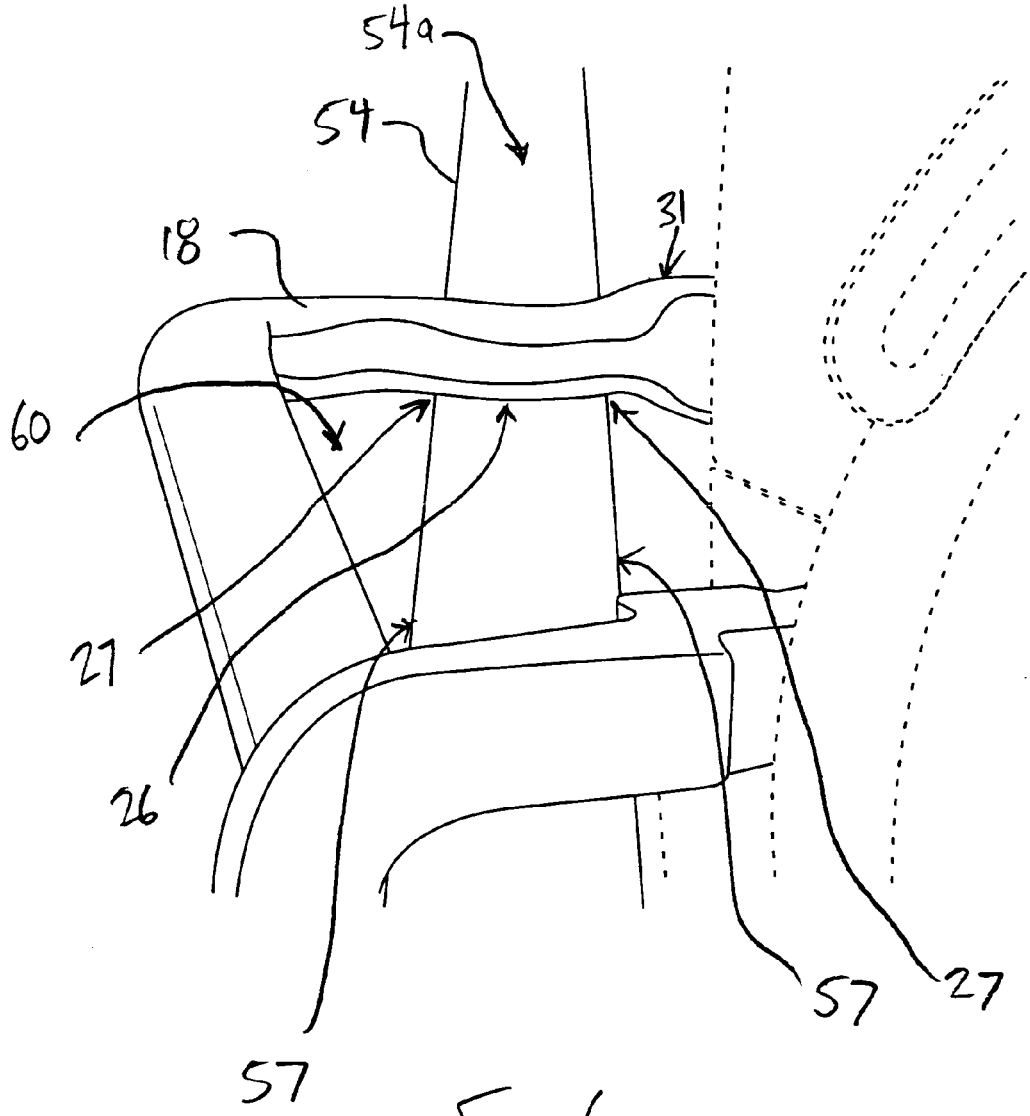
FIG. 6 is a more detailed perspective end view of the device of FIG. 3.

As shown in FIG. 6, in one aspect of the invention, the notch 26 can be formed adjacent an end 31 of the handle support 18 that is coupled to the hand tool 11. In this manner, an opening 60 is formed between the handle and the timber 54 to allow a user to grasp the handle when the hand tool is stored upon the timber. The opening can be of a variety of sizes and configurations, and in one embodiment, the opening is at least 1 inch in width. This feature of the invention allows the device to be used on a hand tool to easily allow the hand tool to be stored on and removed from timbers. In contrast, prior art tool hangers have simply engaged the timber in any location at which the hanger contacted the timber. This engagement resulted in hangers that were susceptible to slipping down a sloped timber under the weight load of a hand tool.

The various components of the safety device can be fabricated or formed individually and assembled as a unit, or, as in one embodiment of the present invention, the safety device can be formed of one integral piece. Similarly, the safety device can be formed of a variety of suitable materials, such as iron or steel, and in one embodiment is formed of a high strength aluminum alloy, such as TZ713 aluminum.

The safety device can be advantageously used in a variety of construction applications and can be used to safely store a hand tool on a variety of timber materials. For example, the timber can be a variety of known types found in and around construction sites, such as 2×4 lumber, 2×6 lumber, etc. The present device has been sized to fit over many common building materials, including manufactured I-joists that are in common use today. The present invention has been found to effectively hold a hand saw in place on structures with a pitch of 12/12 (or 45°), and steeper. This feature of the present invention is highly desirable over conventional devices, which may only serve to hold the saw in place when used on a generally horizontal surface.

The safety device can be used with a variety of hand tools 11. Examples include worm driven hand-held circular saws, which are used extensively in the construction industry. Two examples of similar saws with which the present invention can be used include the Skil™ HD77 and HD77M saws. It also believed that the safety device will fit on many of the Bosch line of hand saws. The safety device can be securely attached to the saw without interfering with any of the operable components of the saw. Once installed upon a hand held saw, the safety device not only enables safe storage of the saw upon a structure, but can be used to rest the saw upon the ground in an upright manner. For instance, the saw can be placed upright on hanger prongs 32*a* and 32*b*, thereby elevating a handle of the saw (not shown in detail) to enable a user to more easily pick the saw up from the ground. Also, the present device is not limited to use on hand saws, but can be used on any number of hand tools, such as drills, screw guns, nail guns, etc.

In one aspect of the invention, a method is provided for utilizing the structure of the device, including the steps of: attaching a handle to the hand tool, the handle being configured to be grasped by a user of the hand tool; disposing about the timber a pair of hanger prongs extending outwardly from an end of the handle; engaging a side of the timber with one of the pair of hanger prongs; and engaging a top of the timber with at least two engagement corners disposed within a concave section of a handle support attached to the handle to thereby enable the hand tool to be safely stored upon the timber.

The step of engaging the side of the timber can include the step of contacting the timber with one of the pair of hanger prongs from substantially a top of the prong to substantially a bottom of the prong.

The step of engaging the top of the timber can include the step of engaging the timber with the engagement corners at outward ends of the top of the timber.

The concave section can be formed adjacent an end of the handle support coupled to the hand tool, such that an opening is formed between the handle and the timber to allow a user to grasp the handle when the hand tool is stored upon the timber.

Figure 4:
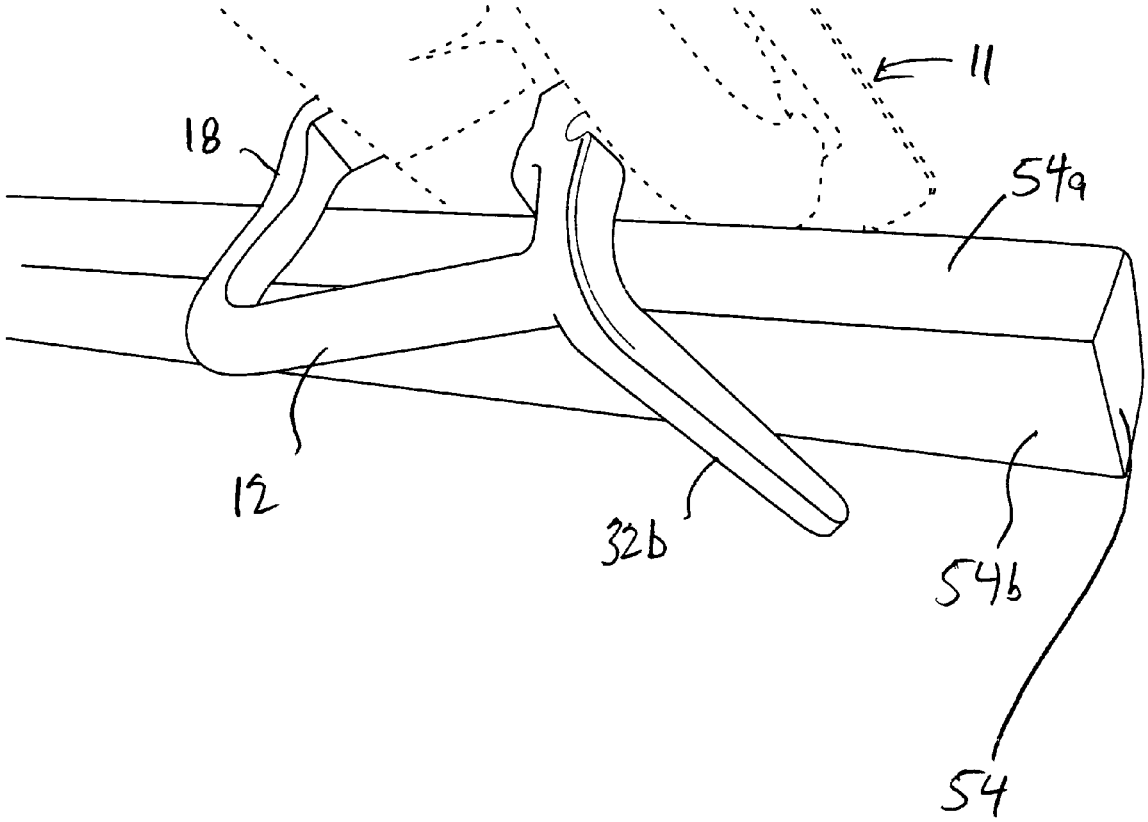
FIG. 4 is a top perspective view of the device of FIG. 3.
Figure 5:
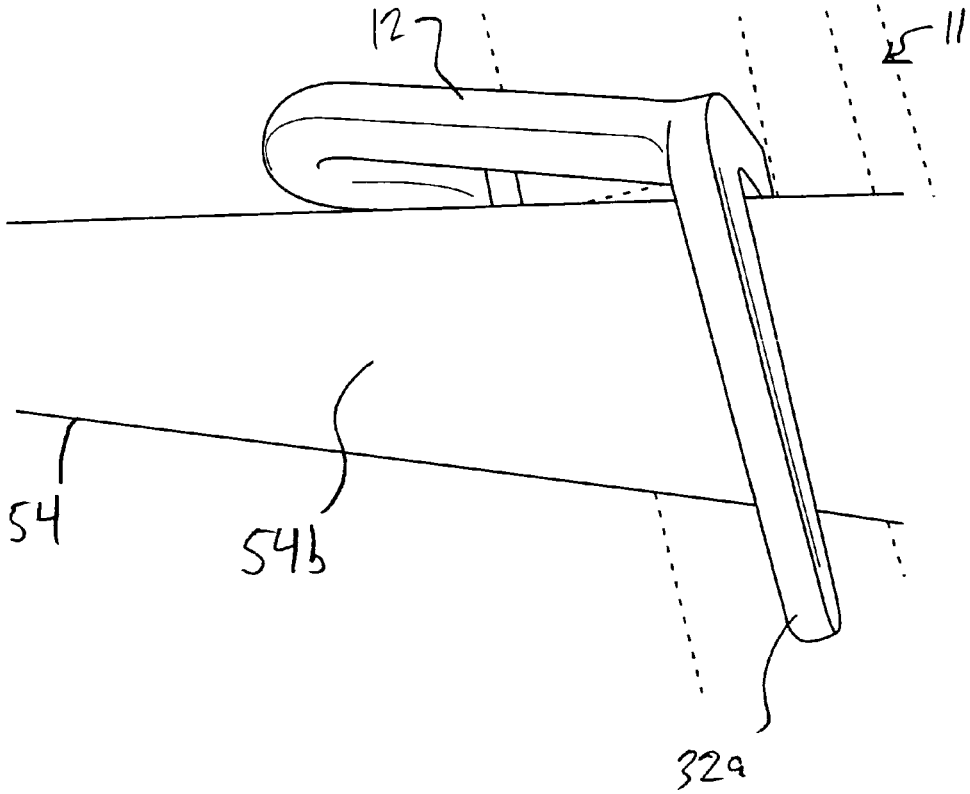
FIG. 5 is a side perspective view of the device of FIG. 3.

FIGS. 4 and 5 illustrate further views of the structure disclosed herein and are included to further aid in understanding the novel features of the invention.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A combination handle and safety device attached to a hand tool safely mounted on a timber, comprising:

a handle, configured to be grasped by a user of the hand tool;

a pair of hanger prongs, extending outwardly from an end of the handle and defining an open channel disposable over a top of a timber, one of the hanger prongs being extendable along a side of the timber; and a handle support, extending from an opposite end of the handle, the handle support having a notch formed therein, the notch including at least two engagement points oriented to be engagable with the top of the timber and being configured to securely engage the timber with the device to enable the hand tool to be safely stored upon the timber;

wherein the handle support projects arcuately away from the handle in a first segment and arcuately toward the handle in a second segment, the handle support being configured to provide support for the handle while increasing available hand space within the handle; and wherein the notch is formed adjacent an end of the handle support coupled to the hand tool, such that an opening is formed between the handle and the timber when the hand tool is stored upon the timber to allow a user to grasp the handle when the hand tool is stored upon the timber.

2. The device of claim 1, wherein the hanger prong extendable along the side of the timber is configured to contact the timber from substantially a top of the prong to substantially a bottom of the prong.

3. The device of claim 2, wherein the two engagement points are engageable with the timber at outward ends of the top of the timber.

4. The device of claim 1, wherein the opening is at least 1 inch in width.

5. The device of claim 1, wherein the handle is coupled to a side of the hand tool with a center of gravity of the combined handle and hand tool being offset from an axis of the timber to bind the timber between the hangar prongs and the engagement points and to force an edge of the hanger prong extending along the side of the timber into the timber when the hand tool is stored upon the timber.

6. A combination handle and safety device attached to a hand tool safely mounted on a timber, comprising:

a handle, configured to be grasped by a user of the hand tool;

a pair of hanger prongs, extending outwardly from an end of the handle and defining an open channel disposable over a top of a timber, one of the hanger prongs being extendable along a side of the timber; and a handle support, extending from an opposite end of the handle, the handle support having a concave section formed therein, the concave section including at least two engagement corners engageable with a top of the timber, the at least two engagement corners being configured to each contact the timber at the top of the timber to securely engage the timber with the safety device to enable the hand tool to be safely stored upon the timber;

wherein the concave section is formed adjacent an end of the handle support coupled to the hand tool, such that an opening is formed between the handle and the timber when the hand tool is stored upon the timber to allow a user to grasp the handle when the hand tool is stored upon the timber.

7. The device of claim 6, wherein the hanger prong extending along the side of the timber is configured to contact the timber from substantially a top of the prong to substantially a bottom of the prong.

8. The device of claim 7, wherein the two engagement corners are oriented to engage the timber at outward ends of the top of the timber.

9. The device of claim 6, wherein the handle support projects arcuately away from the handle in a first segment and arcuately toward the handle in a second segment, the handle support being configured to provide support for the handle while increasing available hand space within the handle.

10. The device of claim 6, wherein the opening is at least 1 inch in width.

11. The device of claim 6, wherein the handle is coupled to a side of the hand tool with a center of gravity of the combined handle and hand tool being offset from an axis of the timber to thereby bind the timber between the hangar prongs and the engagement corners and to force an edge of the hanger prong extending along the side of the timber into the timber when the hand tool is stored upon the timber.

12. A method for securing a hand tool to a timber, comprising the steps of:

attaching a handle to the hand tool, the handle being configured to be grasped by a user of the hand tool;

disposing about a timber a pair of hanger prongs extending outwardly from an end of the handle;

engaging a side of the timber with one of the pair of hanger prongs; and engaging a top of the timber with at least two engagement corners disposed within a concave section of a handle support attached to the handle to thereby enable the hand tool to be safely stored upon the timber.

13. The method of claim 12, wherein the step of engaging the side of the timber includes the step of contacting the timber with one of the pair of hanger prongs from substantially a top of the prong to substantially a bottom of the prong.

14. The method of claim 12, wherein the step of engaging the top of the timber includes the step of engaging the timber with the engagement corners at outward ends of the top of the timber.

15. The method of claim 12, wherein the handle support projects arcuately away from the handle in a first segment and arcuately toward the handle in a second segment, the handle support being configured to provide support for the handle while increasing available hand space within the handle.

16. The method of claim 12, wherein the concave section is formed adjacent an end of the handle support coupled to the hand tool, such that an opening is formed between the handle and the timber to allow a user to grasp the handle when the hand tool is stored upon the timber.

17. The method of claim 12, wherein the handle is coupled to a side of the hand tool with a center of gravity of the combined handle and hand tool being offset from an axis of the timber, and comprising the further step of binding the timber between the hangar prongs and the engagement corners and forcing an edge of the hanger prong extending along the side of the timber into the timber by storing the hand tool upon the timber.

* * * * *